US009938665B2

(12) United States Patent
Malmquist et al.

(10) Patent No.: US 9,938,665 B2
(45) Date of Patent: Apr. 10, 2018

(54) CLOTHING

(71) Applicant: VOITH PATENT GMBH, Heidenheim (DE)

(72) Inventors: Johan Malmquist, Katrineholm (SE); Kjell Karlsson, Derebro (SE); Conny Andersson, Hoegsjoe (SE)

(73) Assignee: Voith Patent GmbH, Heidenheim (DE)

( * ) Notice: Subject to any disclaimer, the term of this patent is extended or adjusted under 35 U.S.C. 154(b) by 0 days.

(21) Appl. No.: 14/911,068

(22) PCT Filed: Jul. 22, 2014

(86) PCT No.: PCT/EP2014/065671

§ 371 (c)(1),
(2) Date: Feb. 9, 2016

(87) PCT Pub. No.: WO2015/018632

PCT Pub. Date: Feb. 12, 2015

(65) Prior Publication Data

US 2016/0177506 A1 Jun. 23, 2016

(30) Foreign Application Priority Data

Aug. 9, 2013 (DE) ..... 10 2013 215 733

(51) Int. Cl.
*D21F 7/08* (2006.01)
*D21F 1/00* (2006.01)
*D21F 1/66* (2006.01)

(52) U.S. Cl.
CPC ..... *D21F 1/0036* (2013.01); *D21F 1/66* (2013.01); *D21F 7/08* (2013.01)

(58) Field of Classification Search
None
See application file for complete search history.

(56) References Cited

U.S. PATENT DOCUMENTS

| | | | | |
|---|---|---|---|---|
| 4,571,359 | A | 2/1986 | Dutt | |
| 6,057,255 | A | 5/2000 | Gass | |
| 7,989,368 | B2 | 8/2011 | Patel et al. | |
| 8,758,569 | B2 | 6/2014 | Aberg et al. | |
| 2005/0133185 | A1 | 6/2005 | Despault et al. | |
| 2005/0167061 | A1 | 8/2005 | Scherb et al. | |
| 2012/0027997 | A1* | 2/2012 | Aberg | D04H 1/44 428/159 |

FOREIGN PATENT DOCUMENTS

| | | | |
|---|---|---|---|
| CN | 1034938 | A | 8/1989 |
| EP | 0786550 | A1 | 7/1997 |
| EP | 1757728 | A1 | 2/2007 |
| WO | 9932715 | A1 | 7/1999 |
| WO | 2010030298 | A1 | 3/2010 |

* cited by examiner

*Primary Examiner* — Mark Halpern
(74) *Attorney, Agent, or Firm* — Laurence A. Greenberg; Werner H. Stemer; Ralph E. Locher

(57) ABSTRACT

A clothing for use in machines for producing a fiber web such as a paper, cardboard, tissue or nonwoven web, in particular a press felt, has a load-absorbing main structure and at least one liquid-absorbing and/or liquid-storing structure arranged on and/or in the load-absorbing main structure. The liquid-absorbing and/or liquid-storing structure is a sponge cloth-like porous structure made of regenerated cellulose, viscose or a mixture thereof.

17 Claims, No Drawings

CLOTHING

This application is a 371 of PCT/EP2014/065671 filed on 22 Jul. 2014.

BACKGROUND OF THE INVENTION

Field of the Invention

The invention relates to a clothing, in particular a clothing for use in a machine for producing a fiber web such as a paper, cardboard, tissue or nonwoven web, in particular a press felt. The clothing has a load-absorbing main structure and at least one liquid-absorbing and/or liquid-storing structure configured on and/or in the load-absorbing main structure.

Clothing's are used in industrial applications in many machines. A large proportion of these is represented by papermaking machines, but also by machines for producing nonwovens, for example fleeces, filter media and the like.

The clothing's in this case are generally used for supporting and guiding and for deflection in such machines. Clothing's in a papermaking machine are present in the forming section, for example, where they receive the paper suspension consisting of fibers, additives and water from the former, dewater it initially and then supply it to the press. Other clothing's, in particular press felts, are provided in said press, which serve not only for the further dewatering of the paper web, but also for pre-calendaring of the web. It is of paramount importance here that the surface of the clothing is designed so that neither mechanical nor hydraulic markings are left behind in the paper web, which would be visible in the end product and would compromise its quality. Further clothing's, for example transfer belts, convey the paper web onwards to the drying section, where clothing's in the form of dryer fabrics, on which increased demands are placed in respect of their temperature tolerance, take over the paper web.

In the pressing section it is very important, as already noted, to configure the clothing's so that the propensity to marking is minimized and the clothing exhibits identical physical properties, such as thickness and porosity for liquids and gases as well as a consistently high absorption volume for liquids, wherever possible for its entire lifetime. The latter in particular is crucial for the quality of the end product. In the event of a clothing becoming compacted during its operating lifetime, causing the absorption volume to become smaller and the porosity to become lower as a result of the displacement of the pores, less water will be absorbed from the paper web and the paper web will be correspondingly more moist when it leaves the pressing section. The consequences include increased energy costs, runnability problems and quality problems in the end product.

Clothing's of the kind mentioned by way of introduction are familiar in a multiplicity of variants, which may exhibit main structures in the form of woven fabrics, laid scrims, knitted fabrics, spiral structures, spiralized yarn sheets or strips, which are combined with one or a multiplicity of other components, such as staple fiber layers, membranes, plastic films, injected particles, impregnations or the like, in order to avoid the above-mentioned problems.

A feature common to all these clothing's in this case is that they are produced from plastics such as polyamide, polyester, polyethylene, etc., and are thus based on fossil fuels in their production process. Increasing efforts are at present being made, from the point of view of the conservation of resources and the environment, to resort to alternative materials, which are either biodegradable and/or can be produced from renewable raw materials.

BRIEF SUMMARY OF THE INVENTION

The object of the invention is to propose a clothing which meets the above-mentioned requirements with regard to environmental compatibility and conservation of resources and, at the same time, exhibits outstanding dewatering characteristics.

The object is accomplished by a clothing as claimed.

It is proposed in this case according to the invention that at least one liquid-absorbing and/or liquid-storing structure arranged on the load-absorbing main structure is provided, which is of porous configuration in the manner of a sponge cloth-like and contains cellulose or consists largely thereof.

A structure, which consists largely of cellulose, is understood in the context of this Patent Application in this case to be a structure in which more than 50% by weight of the structure consists of cellulose.

Cellulose is a natural substance, which is used in a multiplicity of applications in the textile industry. Fibers and textiles produced therefrom are capable of being produced in an environmentally friendly manner, make use of renewable raw materials and are biodegradable.

Further advantageous features and variant embodiments are indicated in the dependent claims.

The cellulose can preferably be present as regenerated cellulose, viscose or as a mixture thereof.

According to one advantageous feature of the invention, a multiplicity of layer-forming structures made of regenerated cellulose, viscose or a mixture thereof can be arranged on one or both sides of the main structure and/or in the main structure. The storage capacity of the clothing can be further increased and equalized as a result of this.

According to one advantageous embodiment, the main structure can also be impregnated or foamed with a solution, which contains regenerated cellulose, viscose or a mixture thereof. A particularly good bond is achieved between the individual layers as a result, which prevents delamination.

The sponge cloth-like structure in this case can be of closed-pored or, most preferably, of open-pored configuration.

The structures made of regenerated cellulose, viscose or a mixture thereof can preferably be connected mechanically, needled, welded, fuzed, laminated, extruded or adhesive bonded or connected by some other appropriate means to the main structure.

The sponge cloth-like porous structure made of regenerated cellulose, viscose or a mixture thereof can be present advantageously in the form of reel material, which is capable of being processed rapidly and simply. As an alternative, individual pieces which are capable of being connected to one another can be processed. Single-piece production, in particular continuous production, is also conceivable and possible.

According to advantageous features of the invention, the main structure can be configured as a woven fabric, laid scrim, crocheted fabric, knitted fabric, extrudate, poured material, compressed material, spiral structure, sintered structure, spiralized structure made of strip materials or yarn sheets with a fiber batt or knitted fabric. It is thus possible to produce clothing's which are optimized for any desired press configurations or also for other positions.

The clothing can comprise further layers of staple fibers, membranes, foils and/or films, in order to further improve the characteristics profile.

Injected particles or impregnations can also be provided in the main structure and/or in the sponge cloth-like porous structure, in order to reduce the propensity to rewetting and compaction.

According to a preferred feature of the invention, the clothing, in particular the sponge cloth-like layer, can be substantially biodegradable.

According to a preferred feature of the invention, the sponge cloth-like porous structure can be implemented as a continuous structure or as a predominantly continuous structure.

Sponge cloth-like structures made of cellulose are usually manufactured so that cellulose is brought into solution, for example by solution in $CS_2$. Particles are added to this solution as a rule. This particle-charged solution is introduced into the mold, for example as a layer, and is solidified by expulsion of the solvent. The pores of the structure are produced by removing or dissolving the particles. A cellulose composite, for example of the kind which results from such a process, is designated in the context of this application as a continuous structure. This structure differs significantly from cellulose structures which are produced by the contiguous arrangement, superimposition or networking of cellulose fibers.

A predominantly continuous structure denotes a continuous structure according to the above definition, which contains a proportion of discrete particles. The particles in this case can be cellulose fibers, but also cotton fibers, mineral particles such as salts or synthetic polymer fibers such as polyamide fibers, polyethylene fibers, polyester fibers or similar. The proportion of these particles in a predominantly continuous structure amounts to less than 50% by weight, preferably to less than 35% by weight, and most preferably to less than 25% by weight.

DESCRIPTION OF THE INVENTION

The invention is described in more detail below.

As already mentioned above, clothing's in machines for producing fibrous material webs such as paper, cardboard, tissue or nonwoven webs are indispensable for supporting, guiding and dewatering. Press felts which absorb a not insignificant part of the liquid from the fibrous material web, store it, and subsequently release it again to suitable collecting devices, find an application in particular in the pressing section of paper, cardboard and tissue machines.

The press felts are usually configured in the form of a load-absorbing main structure, on which additional layers can be arranged with different functions.

The main structure in this case can be present in various forms in a well-known manner. These can include woven fabric, laid scrim, crocheted fabric, knitted fabric, poured, compressed, sintered structures, spiralized structures or spiral structures.

Woven fabrics are characterized by threads intersecting one another substantially at right angles, which can be woven with one another in patterns. They can be of single-layer, two-layer or even multi-layer configuration, the individual layers being capable of being woven together already during the weaving process. Combinations of a multiplicity of separated individual layers are also possible, which can be secured to one another by connecting threads or sewing threads after the production of the individual layers.

Laid scrims likewise have two or more layers of intersecting yarns, which are only deposited on top of each other, however, and are not interwoven. The laid scrim layers can be connected together by appropriate measures, for example the introduction of adhesive or the attachment of bi-component fibers by fusion.

Poured, compressed and sintered structures can be produced, depending on the production process, for example as grid-like structures or in some other suitable form.

Spiral structures consist of helixes, which are positioned next to one another and in an interlocking manner and are connected to one another by fastening wires.

Spiralized structures can be produced from spirally wound strip materials or from yarn sheets, which are combined with a nonwoven fabric. They can be laid in an overlapping or end-to-end manner, and they are connected together appropriately, for example by laser welding or ultrasound treatment along their edges.

Knitted fabric and crocheted fabric are nonwoven structures made from threads, which, for example, have mesh-like forms such as knitted or crocheted structures.

The load-absorbing main structure must be distinguished by a high capacity to withstand tensile loads, since the clothing's are held under tension in the machine and are frequently subjected to changing roller speeds, which introduce high tensile forces into the clothing's. Detachment of the clothing by tearing usually results at least in machine stoppages, which are costly for the operator or lead to damage to the machine and danger to the personnel.

Materials for the yarns of the main structure, for example, are polyamide, in particular PA6, PA6.6, PA6.6T, PA6.10 and PA6.12, and also polyester, PEEK, PET and other common plastics.

The principal object of the further structures, which are connected to the load-absorbing main structure, is to absorb and store the water absorbed from the fibrous material web and, in addition, to prevent further wetting of the fibrous material web after leaving the press, so-called rewetting.

Press felts usually have at least one layer of staple fibers, which are configured in the form of straightened fibers prepared in carding processes. The fibers in this case can exhibit identical or different lengths and fiber thicknesses and can consist of various materials. A multiplicity of staple fiber layers can be provided, which can be formed on one side or on both sides of the load-absorbing main structure. On the one hand, the staple fiber layers define a part of the so-called void volume, that is to say the volume in the interior of the press felt which is available for the absorption or for the storage of water and, on the other hand, the surface of the press felt can be influenced by the appropriate selection of the fibers. If coarse fibers are selected, the press felt is more water-permeable and is less prone to compaction, although the propensity to rewetting will also be higher. Fine fibers result in less permeable felts with a lower propensity to rewetting, but in more rapid compaction.

The introduction of membranes, films, foils, etc., made of polymers or other suitable materials and the spraying of particles as well as the subsequent fusion to form a composite with the base fabric or impregnations are familiar measures against rewetting and compaction.

The press felt according to the invention is characterized by a high water absorption and water storage volume and a low propensity to rewetting and compaction and is also produced using renewable raw materials.

At least one porous, sponge cloth-like structure, which consists of cellulose, such as regenerated cellulose, viscose or a mixture thereof, is arranged according to the invention on and/or in the main structure, which can be configured according to one of the previously described examples. A material of this kind is contained, for example, in the Wettex® sponge cloths supplied by the Freudenberg company and exhibits the desired characteristics in respect of water absorption and water storage.

If cellulose is transformed into a soluble form by chemical change and is brought into solution, a continuous fiber can be produced therefrom in a spinning process. Regenerated cellulose results if the chemical change is undone during the spinning process, so that the continuous fiber consists of chemically unmodified cellulose. Viscose is produced on an industrial scale, starting from cellulose as the basic material, with the help of the viscose process. Sawdust is boiled with chemicals in order to dissolve out the cellulose. The cellulose is then processed with water, caustic soda and carbon disulfide to produce a viscose mash and is solidified into viscose yarn through spinnerets.

The at least one sponge cloth-like structure can be present in this case as a continuous reel material or in the form of pieces, which are connected to one another in an appropriate manner. Single-piece production over a large area, for example involving spraying the cellulose onto a continuous woven main structure, are also conceivable and possible.

It is also possible to apply the cellulose in a dissolved state to the main structure and to impregnate the latter by this means, or to foam the main structure with the sponge cloth-like structure following its introduction by the addition of suitable means.

The individual components can be mechanically connected to one another, for example by needling or by some other appropriate means, for example by the introduction of adhesives, by welding, fuzing, lamination or extrusion on top of each other. A combination with other components, such as further staple fiber layers, films, foils, membranes, particles or impregnations are also possible and conceivable.

A press felt that is configured in this way is characterized by a resource-conserving composition, since a large proportion of synthetic fibers from the petrochemical industry can be replaced by fibers made of renewable raw materials without losses in performance. In addition, a press felt of this kind is at least partially biodegradable after use, which additionally reduces the environmental impact.

The sponge cloth-like structure imparts a uniform pressure distribution to the press felt over the entire surface. The fine pores of the sponge cloth-like structure develop strong capillary forces, so that the fibrous material web is excellently dewatered. On the other hand, the water stored in the press felt can already be removed from the felt once again in the press nip without the aid of additional suction boxes, which brings significant savings in energy consumption.

The invention claimed is:

1. A clothing for use in machines for producing a fiber web, the clothing comprising:

a load-absorbing main clothing structure; and at least one porous structure having one or more characteristics selected from the group consisting of a liquid-absorbing characteristic and a liquid-storing characteristic, said at least one porous structure being disposed in and/or on said load-absorbing main clothing structure, said at least one porous structure having a sponge cloth configuration and consisting primarily of cellulose, said at least one sponge cloth porous structure being a continuous formation or a predominantly continuous formation.

2. The clothing according to claim 1, configured for a machine for producing paper, cardboard, tissue or nonwoven web.

3. The clothing according to claim 1, configured as a press felt.

4. The clothing according to claim 1, wherein said cellulose is regenerated cellulose, viscose or a mixture thereof.

5. The clothing according to claim 4, which comprises a multiplicity of layer-forming structures made of said regenerated cellulose, viscose or a mixture thereof arranged on one or both sides of, and/or in, said clothing main structure.

6. The clothing according to claim 4, wherein said main clothing structure is impregnated or foamed with a solution of said regenerated cellulose, viscose or a mixture thereof.

7. The clothing according to claim 4, wherein at least said structure consisting of regenerated cellulose, viscose or a mixture thereof is substantially biodegradable.

8. The clothing according to claim 1, wherein said sponge cloth porous structure has an open-pore configuration.

9. The clothing according to claim 1, wherein said sponge cloth porous structure has a closed-pore configuration.

10. The clothing according to claim 1, wherein said at least one porous structure is one or a plurality of porous structures formed of regenerated cellulose, viscose or a mixture thereof, and said porous structures are connected to one another and/or to said main clothing structure by a process selected from the group consisting of mechanically connected, needled, adhesive bonded, welded, extruded, laminated and fused.

11. The clothing according to claim 1, wherein said at least one porous structure is formed of regenerated cellulose, viscose or a mixture thereof is connected to said main clothing structure by a process selected from the group consisting of mechanically connected, needled, adhesive bonded, welded, extruded, laminated and fused.

12. The clothing according to claim 1, wherein said sponge cloth porous structure is produced and processed from regenerated cellulose, viscose or a mixture thereof in the form of reel material, or from individual pieces that are connected to one another, or as a single-piece structure.

13. The clothing according to claim 1, wherein said sponge cloth porous structure is formed as a continuous structure.

14. The clothing according to claim 1, wherein said main clothing structure is a structure selected from the group consisting of a woven fabric, laid scrim, crocheted fabric, knitted fabric, spiral structure, extrudate, poured material, compressed material, sintered structure, spiralized structure made of strip materials and yarn sheets with fiber batts.

15. The clothing according to claim 1, which comprises further layers selected from the group consisting of staple fibers, membranes, foils and films.

16. The clothing according to claim 1, wherein one or both of said main clothing structure or said sponge cloth porous structure comprises injected particles or impregnations.

17. The clothing according to claim 1, formed, at least in part, of biodegradable materials.

* * * * *